US006016026A

United States Patent [19]

Lee

[11] Patent Number: 6,016,026

[45] Date of Patent: Jan. 18, 2000

[54] IMPREGNATED CATHODE FOR LOW POWER CATHODE-RAY TUBE

[75] Inventor: Jong Hwan Lee, Kyungsangbuk-do, Rep. of Korea

[73] Assignee: LG Electronics Inc., Seoul, Rep. of Korea

[21] Appl. No.: 08/987,199

[22] Filed: Dec. 9, 1997

[30] Foreign Application Priority Data

Dec. 11, 1996 [KR] Rep. of Korea ..... 96-64162

[51] Int. Cl.[7] ..... H01J 29/04; H01J 19/22

[52] U.S. Cl. ..... 313/346 R; 313/346 DC; 313/270; 313/337

[58] Field of Search ..... 313/346 R, 346 DC, 313/270, 337

[56] References Cited

U.S. PATENT DOCUMENTS 5,113,110 5/1992 Jang ..... 313/346 DC
5,306,189 4/1994 Sugimura et al. ..... 313/346 DC

*Primary Examiner*—Nimeshkumar D. Patel
*Assistant Examiner*—Joseph Williams
*Attorney, Agent, or Firm*—Fleshner & Kim

[57] ABSTRACT

A low power impregnated cathode consisting of a pallet, a cup, an inner sleeve, a cap, and an outer sleeve, is characterized in that the diameter of the pellet is less than at least one and half times of the thickness of the pellet, and is characterized in that an outer diameter of the bottom part of the outer sleeve is larger than an outer diameter of the top part thereof.

22 Claims, 2 Drawing Sheets

IMPREGNATED CATHODE FOR LOW POWER CATHODE-RAY TUBE

BACKGROUND OF THE INVENTION

1. Field of the Invention

The present invention relates to an impregnated cathode of a cathode-ray cube (hereinafter, referred to as CRT), and more particularly to a low power impregnated cathode of the CRT.

2. Discussion of the Related Art

In general, in a wide CRT requiring high definition and high luminance, an impregnated cathode capable of emitting high current beam for a long time has been used.

Referring to FIG. 1, there will be explained the structure of the impregnated cathode according to the prior art.

A pellet 1 is installed in a cup 2, the pellet 1 being used for emitting electron. The cup 2 is coupled with an inner sleeve 4 by laser welding. The inner sleeve 4 is coupled with an outer sleeve 5 by a tab 3. A cathode support (not shown) is positioned near to the outer sleeve 5. Further, a heater 6 is mounted in the internal part of the inner sleeve 4, i.e., in the bottom part of the pellet 1.

In the process of the manufacture of the pellet 1, metal powder is made of tungsten powder or made by mixing the tungsten powder which rare earth metal such as Os, Ir, and Ru. The metal powder becomes a porous metal having the porosity of 20~30% by sintering. Then, the pellet 1 is made by impregnating the porous metal with electron emission material. The electron emission material consists of BaO, CaO, and $Al_2O_3$ at the mole ratio of 4:1:1, 5:3:2, or 3:1:1. Further, materials such as Ir, Os, Ru, Os-Ru, W-Ir, and W-Os are sputtered at Ar gas atmosphere and then the surface 7 of the pellet 1 is coated with the sputtering material of the thickness of 150 $\mu$m, so that the pellet 1 is operated at the cathode temperature of 950–1000° C., (brightness temperature).

Meanwhile, there are two kinds of the impregnated cathodes, i.e., a normal impregnated cathode having heater current of 680 mA, and a low power impregnated cathode having heater current of 320 mA. In the normal impregnated cathode, the pellet 1 is designed to have the thickness H of 0.5 mm and the diameter D of 1.5 mm.

In order to implement the low power impregnated cathode, the size of all the cathode components like the pellet 1 should be reduced. Accordingly, according to the prior art, the diameter D of the pellet 1 is reduced to 1.0 mm and its thickness H thereof is maintained at 0.5 mm.

However, there are provided the following problems in the low power impregnated electrode according to the prior art.

First, the amount of electron emission material to be impregnated in the pellet is reduced, since the size of the pellet is reduced in order to lower the heater current. Accordingly, the heater current is reduced and also the electron emission capability is reduced.

Second, since the cathode consists of the pellet, cup, and inner sleeve, and the cap having the pellet is connected with the inner sleeve by welding, a lot of components are used. Further, the pellet might be damaged because of the welding of the cup and the inner sleeve.

Third, the loss due to heat conduction can be increased because the contact surface between the outer sleeve and the cathode support is wide.

Lastly, the diameter of the outer sleeve of the low power impregnated cathode is smaller than that of the outer sleeve of the normal impregnated cathode, so that the components like the cathode support of the normal impregnated cathode should be changed.

SUMMARY OF THE INVENTION

Therefore, an object of the present invention is to provide a low power impregnated cathode capable of maintaining its life time and its electron emission capability at the same level as the normal impregnated cathode.

Another object of the present invention is to provide a low power impregnated cathode capable of reducing the number of the components and simplifying the assembling.

Additional features and advantages of the invention will be set forth in the description which follows, and in part will be apparent from the description, or may be learned by practice of the invention. The objectives and other advantages of the invention will be realized and attained by the structure particularly pointed out in the written description and claims hereof as well as the appended drawings.

To achieve the above objects in accordance with the present invention, as embodied and broadly described, the low power impregnated cathode is characterized in that the diameter of the pellet is less than at least one and one-half (1.5) times of the thickness of the pellet, and is characterized in that an outer diameter of the bottom part or the outer sleeve is larger than an outer diameter of the top part thereof.

Further, in the low power impregnated cathode of the present invention, a concave part where the pellet is installed is formed in an end of the inner sleeve so that the cup and the inner sleeve can he implemented in a single body.

It is to be understood that both the foregoing general description and the following detailed description are exemplary and explanatory and are intended to provide further explanation of the invention as claimed.

BRIEF DESCRIPTION OF THE DRAWINGS

The accompanying drawings, which are included to provide a further understanding of the invention and are incorporated in and constitute a part of this specification, illustrate embodiments of the invention and together with the description serve to explain the principles of the invention.

DETAILED DESCRIPTION OF PREFERRED EMBODIMENT

Reference will now be made in detail to the preferred embodiments of the present invention, examples of which are illustrated in the accompanying drawings.

Figure 1:
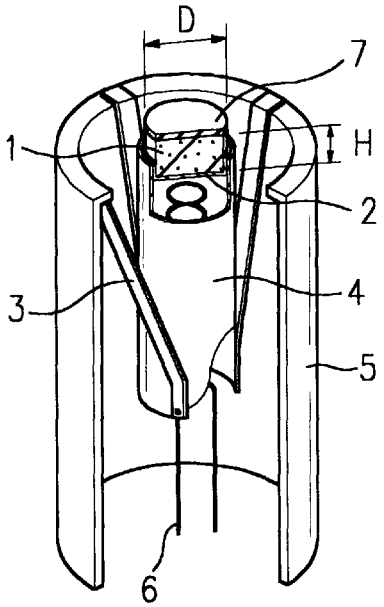
FIG.1 Prior Art
FIG. 1 is a perspective view illustrating an impregnated cathode according to the prior art.
Figure 2:
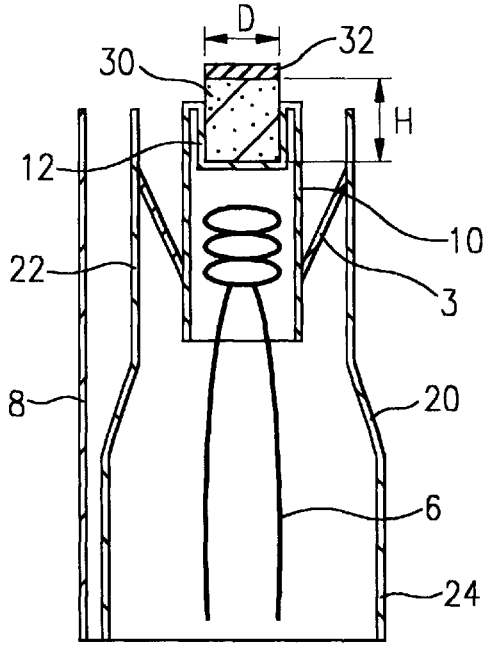
FIG. 2 is a cross sectional view illustrating a low power impregnated cathode according to the present invention.

FIG. 2 is a cross sectional view illustrating a low power impregnated cathode according so the present invention.

In the present invention, a pellet 30 for emitting electron, is directly coupled with an inner sleeve 10 by welding, without having a cup of the prior art. The inner sleeve 10 is coupled with an outer sleeve 20 by a tab 3. A cathode support 8 is positioned near to the outer sleeve 20. Further, a heater 6 is mounted in the inner sleeve 10, i.e., the bottom part of the pellet 30.

Of course, the pellet 30 can be mounted by using the cup and the inner sleeve, like the prior art, but, it is desirable that the cup and inner sleeve are implemented in a one-body so as to reduce the number of the components and to simplify the assembling.

There will be explained hereinafter each construction element according to the present invention.

The inner sleeve 10 is a cylindrical shape in which one end is blocked in one end of the inner sleeve 10 a concave part 12 is formed. That is, the bottom part of the pellet 30 is mounted in the concave part 12 of the inner sleeve 10 by a laser welding.

Further, the outer sleeve 20 is designed to have the larger diameter in the bottom part than in the top part, so that the low power impregnated cathode can be implemented without charging the conventional cathode support 8 and the heat loss to the outside can be reduced accordingly.

In such a structure, in order to reduce the consumption power of the heater, the bulk of the pellet should be reduced. In this case, if the diameter of the pellet 30 is reduced and the thickness thereof is constant, the electron emission material to be impregnated is reducer and the electron emission capability goes down accordingly. Thus, according to the present invention, the diameter of the pellet is reduced in order to lower the heater power and at the same time the thickness of the pellet is increased in order to obtain the electron emission capability in the same level of the normal impregnated cathode, thereby it is possible to reduce the heater power and also the electron emission capability and the life time is the same as the normal impregnated cathode according to the prior art. According to the preferred embodiment, the diameter D of the pellet 30 is less than at least one and one-half (1.5) times as much as the thickness H thereof.

In the preferred embodiment of the present invention, the heater current is designed to be below 340 mA under the heater voltage of 6.3 V (cathode temperature=990° $C._D$)

Further, in the preferred embodiment of the present invention, the diameter D of the pellet 30 is designed to be less than 1.2 mm and the thickness H thereof is designed to be more than 0.8 mm. Further, the pellet 30 is made of more than one kind of metal powder such as W, Mo, Ta, Os, and Ir. Also, the pellet is impregnated by the elector emission material, which is made by mixing BaO, CaO, and $Al_2O_1$ at the mole ratio of 4:1:1, 5:3:2, or 3:1:1. Moreover, the surface 32 of the pellet 30 is intended to be coated with one kind of metal among Ir, Os, Ru, Re, Mo-Os, Ir-Ta, and W-Re.

On the other hand, the outer sleeve 20 is made of Ta or Kovar(Cr-Co-Fe alloy system). The outer diameter of the top part 22 of the outer sleeve 20 is more than 1.8 mm and that of the bottom part 24 thereof is less than 3.2.

Figure 3:
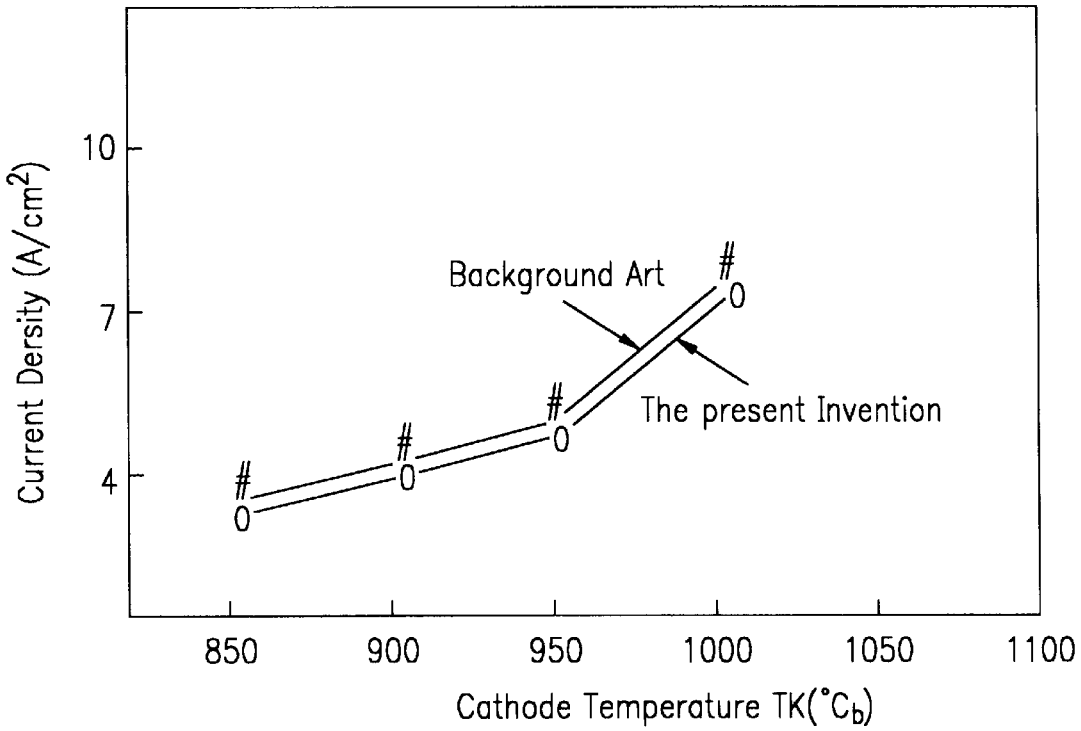
FIG. 3 is a graph illustrating current density for cathode temperature obtained by comparing the normal impregnated cathode according to the prior art with the low power impregnated cathode according to the present invention.
Figure 4:
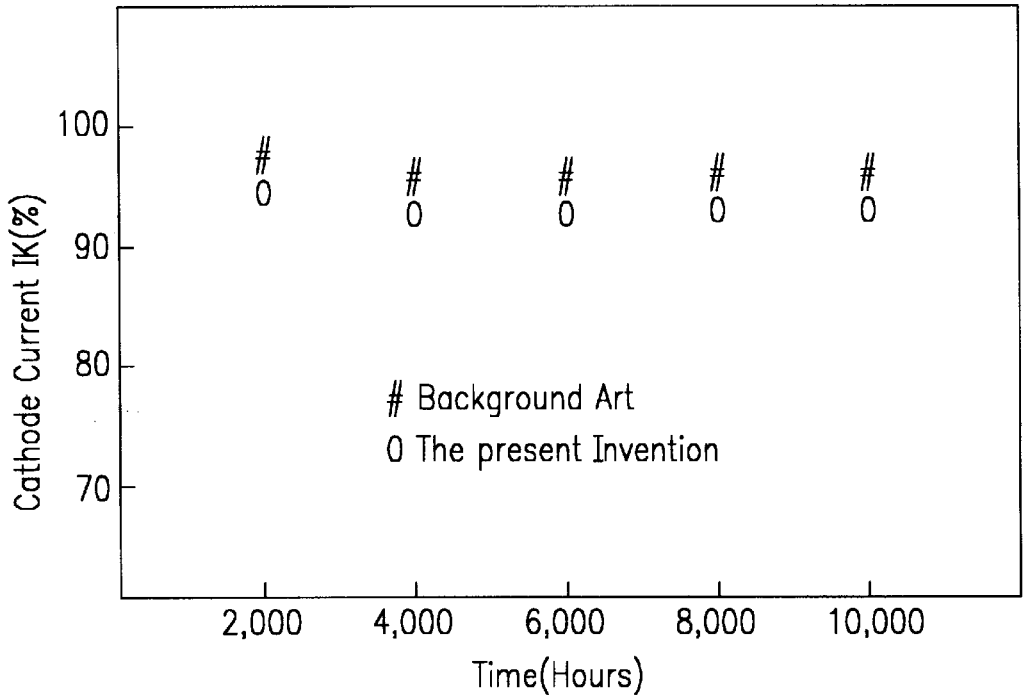
FIG. 4 is a graph illustrating cathode current for the time obtained by comparing the normal impregnated cathode according to the prior art with the low power impregnated cathode according to the present invention.

FIGS. 3 and 4 are graphs illustrating current density for cathode temperature and cathode current of the time obtained by comparing the normal impregnated cathode according to the prior art and the low power impregnated cathode according to the present invention.

Referring to FIG. 3, it is known that the low impregnated cathode according to the present invention has the electron emission capability in the same level as the normal impregnated cathode according to the prior art and also the cathode is operated under the low power.

Referring to FIG. 4, it is also known that cathode current of more than 90% can be maintained even for the time up to 10,000 hours.

As mentioned above, according to the present invention, it is possible to reduce the consumption cower while the electron emission capability according to the present invention is maintained at the same level as the conventional normal impregnated cathode.

Further, the outer diameter of the bottom part of the outer sleeve is larger than that of the top part thereof and only its bottom part is thus contacted thereto, so that it is possible to design the low power heater since the heat loss to the outside can be reduced. Also, it is possible to install the low power impregnated cathode according to the present invention without changing the conventional cathode support.

Moreover, the number of the components and the assembling steps can be reduced because the conventional cup and the inner sleeve can be implemented in a one-body.

In the present invention, the cable electron emission can be made. The low power impregnated cathode of the present invention can be applied to a wide Brawn tube, a high definition tube (HDT), and a wide color display tube (CDT).

It will be apparent to those skilled in the art that various modifications and variations can be made in the low power impregnated cathode of the present invention without departing from the spirit or scope of the invention. Thus, it is intended that the present invention cover the modifications and variations of this invention provided they come within the scope of the appended claims and their equivalents.

What is claimed is:

1. A cathode comprising:

a pellet;

a cup;

an inner sleeve;

a tab; and an outer sleeve, wherein a diameter of said pellet is less than at least one and one-half (1.5) times a thickness of said pellet, and an outer diameter of a bottom part of said outer sleeve is larger than an outer diameter of a top part of said outer sleeve.

2. The cathode of claim 1, wherein said cup is formed by an end of said inner sleeve, such that said cup and said inner sleeve comprise a monolithic piece.

3. The cathode of claim 1, wherein the diameter of said pellet is less than 1.2 mm and the thickness of said pellet is more than 0.8 mm.

4. The cathode of claim 1, wherein the outer diameter of the top part of said outer sleeve is more than 1.8 mm and the outer diameter of the bottom part is less than 3.2 mm.

5. The cathode of claim 1, further comprising a heater adapted to heat said pellet, wherein the heater has an operational current of less than 340 mA.

6. The cathode of claim 5, wherein an operational temperature of the cathode is approximately 990° $C._b$.

7. The cathode of claim 1, wherein said pellet comprises a porous material having at least two of W, Mo, Ta, Os, and Ir, and is impregnated with an electron emission material having BaO, CaO, and $Al_2O_2$.

8. The cathode of claim 7, wherein said pellet further comprises a surface coated with at least one of Ir, Cs, Ru, Re, Mo-Os, Ir-Ta, and W-Re.

9. The cathode of claim 1, wherein said pellet is welded to said cup.

10. A pellet for an impregnated cathode, comprising:

a porous material having a diameter and a thickness; and an electron emission material impregnating said porous material, wherein the diameter of said porous material is less than at least 1.5 times the thickness of said porous material.

11. The pellet of claim 10, wherein the thickness of said porous material is greater than 0.8 mm.

12. The pellet of claim 10, wherein said porous material comprises at least two of W, Mo, Ta, Os, and Ir, and said electron emission material comprises BaO, CaO, and $Al_2O_2$.

13. The pellet of claim 10, wherein said porous material and said electron emission material are adapted to operate in a cathode that operates at a temperature of approximately 950–1000° $C._b$ with a heater current of less than approximately 340 mA.

14. An impregnated cathode, comprising:

an inner sleeve;

a cup coupled to said inner sleeve; and a pellet supported by said cup, wherein a diameter of said pellet is less than at least 1.5 times a thickness of said pellet.

15. The impregnated cathode of claim 14, wherein said inner sleeve, said cup and said pellet are adapted to operate with a heater having a current of less than approximately 340 mA.

16. The impregnated cathode of claim 15, wherein an operational temperature of said cathode is approximately 990° $C._b$.

17. The impregnated cathode of claim 14, wherein said cup and said inner sleeve comprise a monolithic piece.

18. The impregnated cathode of claim 17, wherein an end of said inner sleeve is substantially perpendicular to a side of said inner sleeve, and comprises a concave surface configured to hold said pellet.

19. The impregnated cathode of claim 17, wherein said pellet is welded to said cup.

20. The impregnated cathode of claim 14, further comprising an outer sleeve, wherein an outer diameter of a bottom portion of said outer sleeve is greater than an outer diameter of a top portion of said outer sleeve.

21. The impregnated cathode of claim 14, wherein said pellet comprises a porous material having at least two of W, Mo, Ta, Os, and Ir, and wherein pellet is impregnated with an electron emission material having BaO, CaO, and $Al_2O_2$.

22. The impregnated cathode of claim 21, wherein a mole ratio of said BaO, CaO, and $Al_2O_2$ is one of 4:1:1, 5:3:2 and 3:1:1.

* * * * *